US007162895B2

(12) United States Patent
Lonati

(10) Patent No.: US 7,162,895 B2
(45) Date of Patent: Jan. 16, 2007

(54) CIRCULAR KNITTING MACHINE AND METHOD FOR COLLECTING THE FABRIC PRODUCED BY A CIRCULAR KNITTING MACHINE

(75) Inventor: Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 148 days.

(21) Appl. No.: 11/104,709

(22) Filed: Apr. 13, 2005

(65) Prior Publication Data

US 2005/0229642 A1 Oct. 20, 2005

Related U.S. Application Data

(63) Continuation of application No. PCT/IT2004/000211, filed on Apr. 14, 2004.

(51) Int. Cl.
*D04B 15/88* (2006.01)

(52) U.S. Cl. ..... 66/151

(58) Field of Classification Search ..... 66/151, 66/150, 152, 153

See application file for complete search history.

(56) References Cited

U.S. PATENT DOCUMENTS 5,157,948 A * 10/1992 Rikiishi et al. ..... 66/151
5,317,885 A * 6/1994 Vignoni ..... 66/151
5,566,558 A * 10/1996 Tsuchiya ..... 66/151
6,640,590 B1 11/2003 Thoman et al.
2002/0166347 A1 11/2002 Thoman et al.

FOREIGN PATENT DOCUMENTS

DE 30 01 814 A1 7/1981

OTHER PUBLICATIONS

N. Ucar: "Massnahmen gegen Fehler in Rundgestricken", Melliand Textilberichte, Nov. 1, 1998, XP002311424, pp. 836-838, (p. 836, col. 3, par. 6-p. 837, col. 1, par. 9; fig. 3).
Georges Scolart: "Ouverture et enroulement au large", Filiere Maille, Jun. 1, 2002, XP002311425, pp. 58-66.

* cited by examiner

*Primary Examiner*—Danny Worrell
(74) *Attorney, Agent, or Firm*—Pearne & Gordon LLP

(57) ABSTRACT

A method for collecting the fabric (4) produced by the cylinder (3) of a circular knitting machine, comprising at least the steps of taking down said fabric (4), cutting and collecting it, in which the fabric is cut along a predefined cutting trajectory inclined with respect to the rotation axis ("X") of the cylinder (3). The cutting means (10) are actuated in rotation at a speed differing from the speed of the cylinder (3) of the knitting machine. It is further provided for a circular knitting machine comprising a cylinder (3) turning around a central rotation axis ("X") so as to produce a tubular fabric (4), a take-down and collecting assembly (6) engaging the fabric (4) on the opposite side with respect to the cylinder and equipped with cutting means (10). Said cutting means can be actuated in rotation around the central rotation axis ("X") at an angular speed differing from the speed of the cylinder (3).

21 Claims, 10 Drawing Sheets

CIRCULAR KNITTING MACHINE AND METHOD FOR COLLECTING THE FABRIC PRODUCED BY A CIRCULAR KNITTING MACHINE

The present invention relates to a circular knitting machine and to a method for collecting the fabric produced by a circular knitting machine.

The present invention relates to the textile field, and in particular to the production of fabrics by means of circular knitting machines equipped with a rotary cylinder and a take-down and collecting assembly for taking down and collecting the fabrics produced by the rotary cylinder. In further detail, as disclosed and described in patent IT1.309.184, issued to the same Applicant, devices for taking down and collecting tubular fabrics are generally mounted turnably onto the machine frame and act onto the tubular fabrics from the corresponding cylinder.

As a rule, the movable take-down and collecting assembly comprises a device for flattening tubular fabrics being fed and one or more traction elements for controlled feeding of the fabric being worked. Moreover, open-type collecting assemblies, which enable the automatic cutting of the knitted tube and the collection of flat fabric, further comprise a cutting element for cutting the flattened fabric along a generatrix and an opening device for outspreading the cut fabric in a single layer.

As is known, the movable take-down and collecting assembly turns integrally with the machine cylinder. In other words, both the machine cylinder and the take-down and collecting assembly turn around a common central rotation axis with the same angular speed. The simultaneous synchronized movement of the machine cylinder and of the take-down and collecting assembly is achieved by dragging of the take-down and collecting assembly, or by a mechanical drive imparting to the take-down and collecting assembly the same angular speed as the cylinder.

The knitting machines described above have some drawbacks, mainly in case discontinuous or over-plied yarns, i.e. subject to an intrinsic structural fabric twisting, which phenomenon is commonly known as "turn".

This behavior, due to the intrinsic stresses of the structure of the aforesaid yarns, which have twists increasing their structural resistance, affects the structure of tubular fabrics produced by knitting machines to a significant extent, which fabrics can be deformed or plied with a cylindrical shape having a "twisting" or a deformed flat shape, if cut directly by the take-down and collecting assembly. The tubular fabrics produced, cut and collected by the machine then tend to deform because of the stresses referred to above. This results in a subsequent waste of a relevant portion of fabric in case the fabric is further cut after deformation, or in the quality decrease of the manufactured items obtained with said fabrics, which are deformed.

In an attempt to overcome these problems, some manufacturing contrivances have been implemented for balancing yarns so as to avoid self-plying structures.

Some of these are the use of balanced twisting yarns (which are however quite expensive), the use of opposed twisting yarns (which have however an unwanted effect known as "millerays"), or the collection of the tubular fabric and its manual cutting following the natural twisting of the fabric.

In the latter solution, the knitted tube is hung and dropped without stresses, so as to let it deform with its natural helical twist. The fabric is then manually cut in a twisted way with respect to the "ribs" or vertical cords of the knitted fabric, i.e. in "twisted warp", though following the deformation helix of said fabric.

The flat fabric thus obtained is cut "twistedly", though following its deformation line, and it is thus possible to prevent subsequent deformation of the flat fabric, since the fabric has already got twisted and has thus reached its structural stability.

Using said fabrics with "twisted cutting" it is thus possible to obtain clothing items that can then be treated in various ways, for instance dyed, washed at high temperatures, milled for softening them or other, though keeping their structure.

Twisted cutting does not give rise to any aesthetical problem on the finished item, since for given thinnesses the finished item is homogenous after the various treatments and vertical cords or "wales" can no longer be distinguished from horizontal courses. The fact that the fabric has been cut twistedly with respect to the vertical cords is thus irrelevant from an aesthetical point of view.

Thanks to a cutting of the tubular fabric carried out after its deformation and taking in account said deformation, it is thus possible to obtain items which are stable and do not deform either during pre-sale or post-sale treatments because of various washing and ironing operations.

FIG. 9 shows a knitted tube 4 manufactured with twisted yarns, which before deforming appears as an ordinary tube manufactured with conventional yarns, and which is cut along a cutting line following the vertical knitted cords or wales 4*a* and parallel to the central axis "X". The flat fabric thus obtained is shown in FIG. 10, said fabric being cut parallel to the vertical knitted cords or wales 4*a* though tending afterwards to twist as shown in the figure (in an exaggerated way for reasons of clarity) causing the deformation of the knitted items manufactured with said fabric 4.

FIG. 9*a* shows the same knitted tube 4 after deformation taking place when said tube 4 is hung without external tractions, as indicated by angle $\alpha$ formed between the orientation line of the vertical cords or wales 4*a* after deformation and the corrected cutting line 5 in "twisted warp". Said cutting line 5, "twisted" with respect to the wales 4*a*, enables to obtain the fabric as in FIG. 10*a*, which is cut twistedly with respect to the wales 4*a*, but being already deformed will no longer deform, thus being dimensionally stable.

However, manufacturing fabrics according to the aforesaid empirical manual process is quite expensive, little reliable and low repeatable, since it depends on the operator's ability.

Thus, products with different quality are often present, together with a high amount of scraps, with subsequent quite relevant economical losses.

Moreover, said solution cannot be applied to "OPEN"-type machines, which were conceived for preventing creases on the collected fabric, in which the tubular fabric is cut directly by the take-down and collecting assembly and collected as a one-layer flat fabric before deformation can occur.

Under these circumstances, the technical task underlying the present invention is to provide a circular knitting machine and a method for manufacturing fabrics that can basically obviate the aforesaid drawbacks. In the framework of said technical task, an important aim of the invention is to conceive an OPEN-type circular knitting machine whose cutting, take-down and collecting assembly, operating on tubular fabrics produced by the machine cylinder, allows to carry out automatically a fabric cutting considering the subsequent fabric deformation due to internal stresses. Another technical task of the invention is to provide a machine and method that enable to cut automatically the tubular fabrics produced by the machine in a geometrically detected and mathematically controlled way thanks to the control systema of said knitting machine, so as to obtain flat fabrics that are dimensionally stable and are not subject to subsequent structural deformations. The technical task and the aims referred to above are basically achieved by a circular knitting machine and by a method for manufacturing fabrics characterized in that they comprise one or more of the technical solutions claimed below.

The following contains by way of mere non-limiting example the description of some preferred—though not exclusive—embodiments of a machine according to the invention, shown in the accompanying drawings, in which:

FIG. 1 shows a perspective view of a knitting machine having a device for outspreading and collecting tubular fabrics produced by a cylinder of said knitting machine, according to the present invention;

FIG. 1*a* shows a stationary frame of the machine as in the previous figure;

Figure 1:
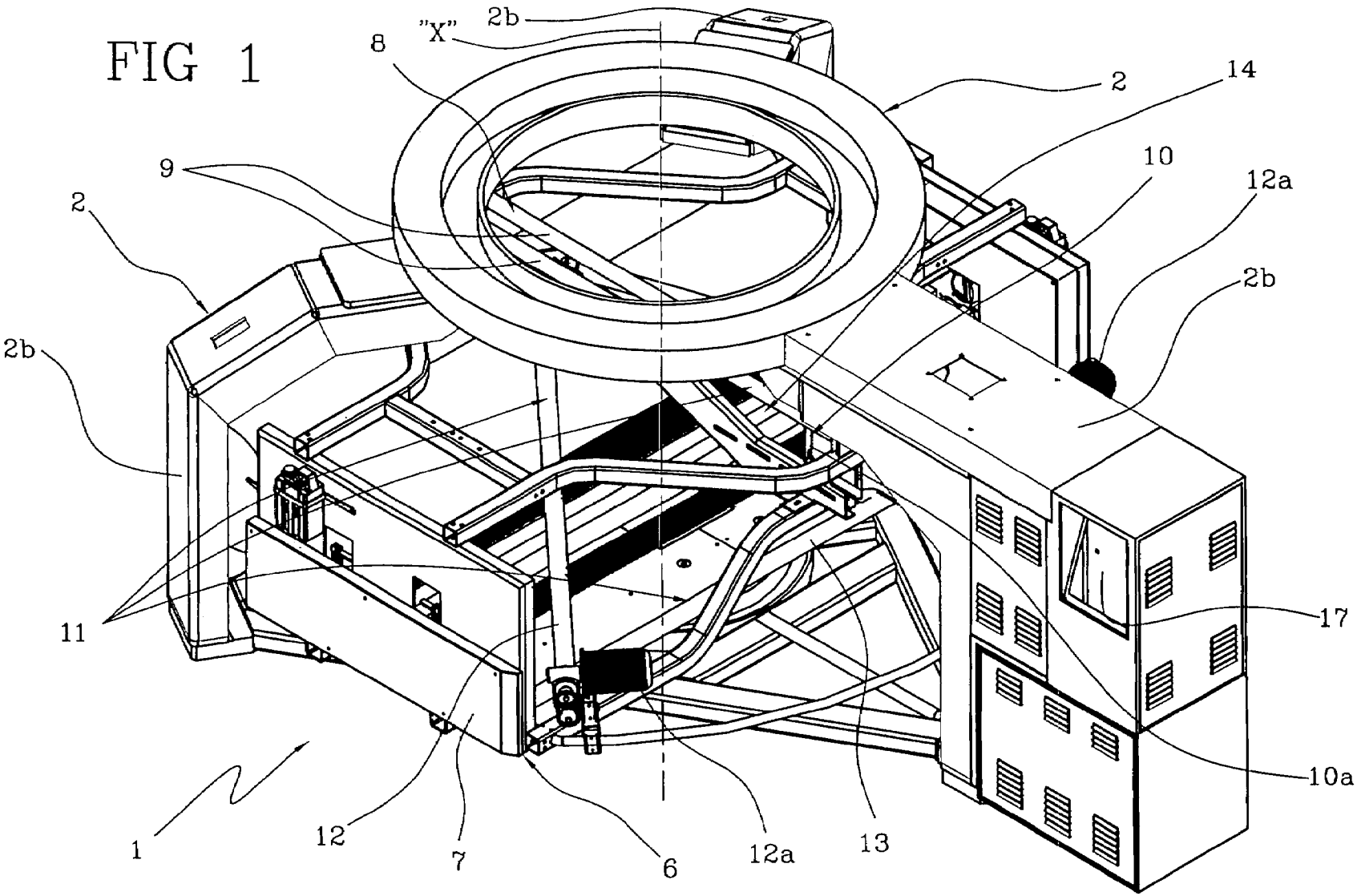
Figure 9A:
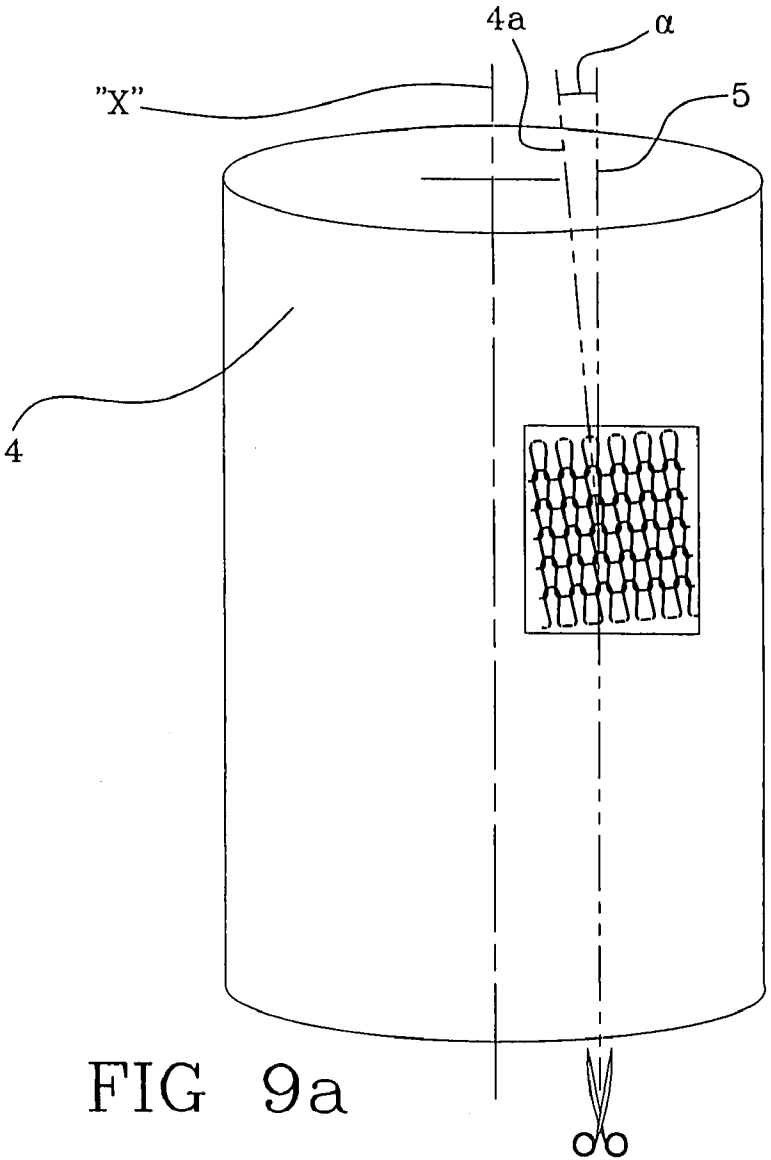
FIG. 9 shows schematically a non-deformed tubular fabric with the indication of the traditional cutting line, parallel to the rotation axis and to the axis of the "ribs" of the knitted fabric.
Figure 9:
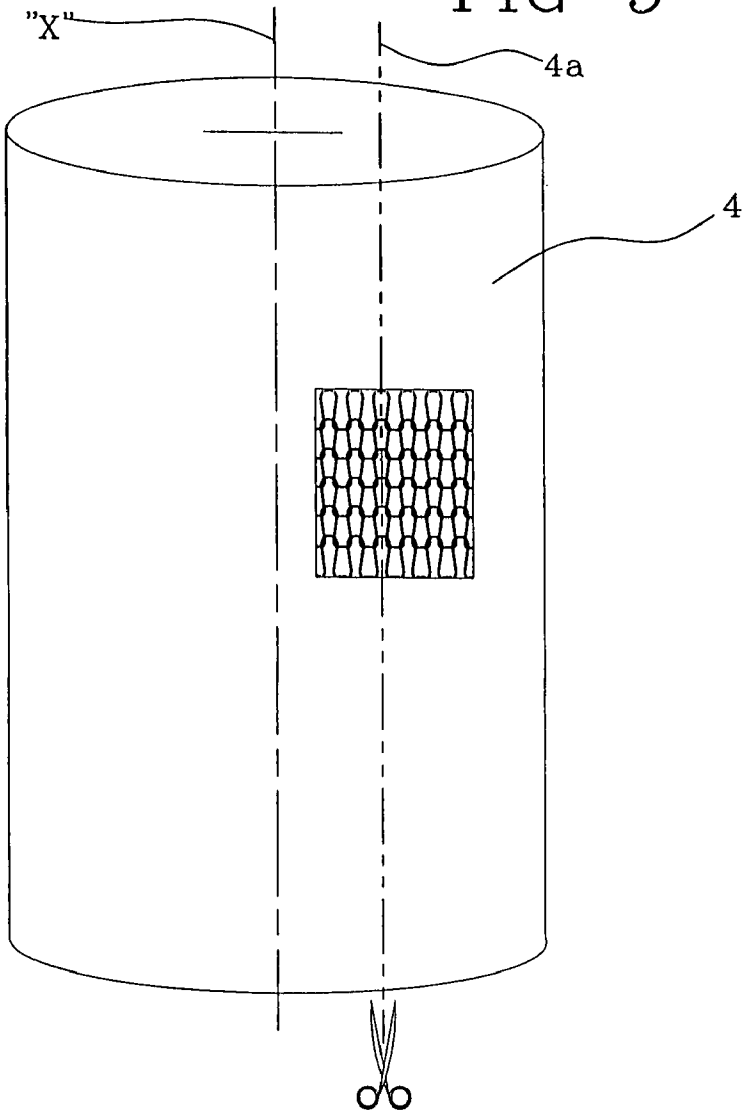
Figure 10A:
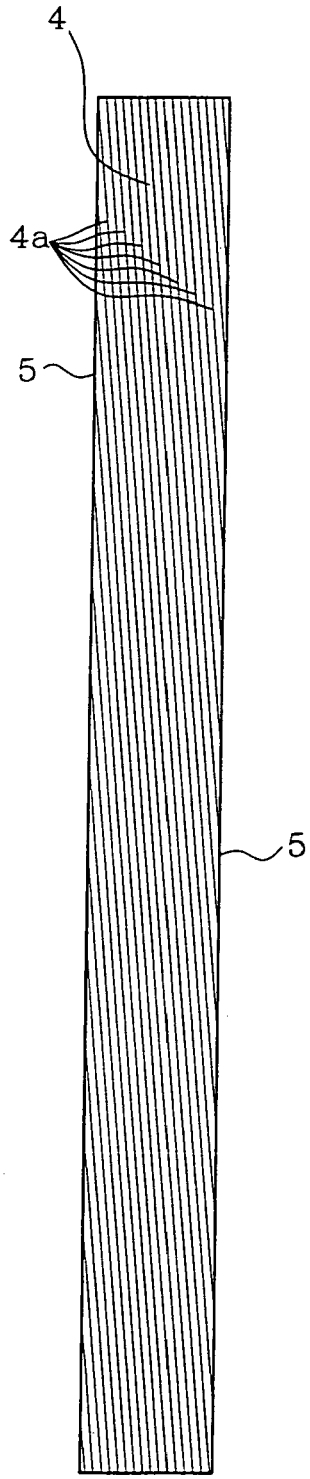
Figure 10:
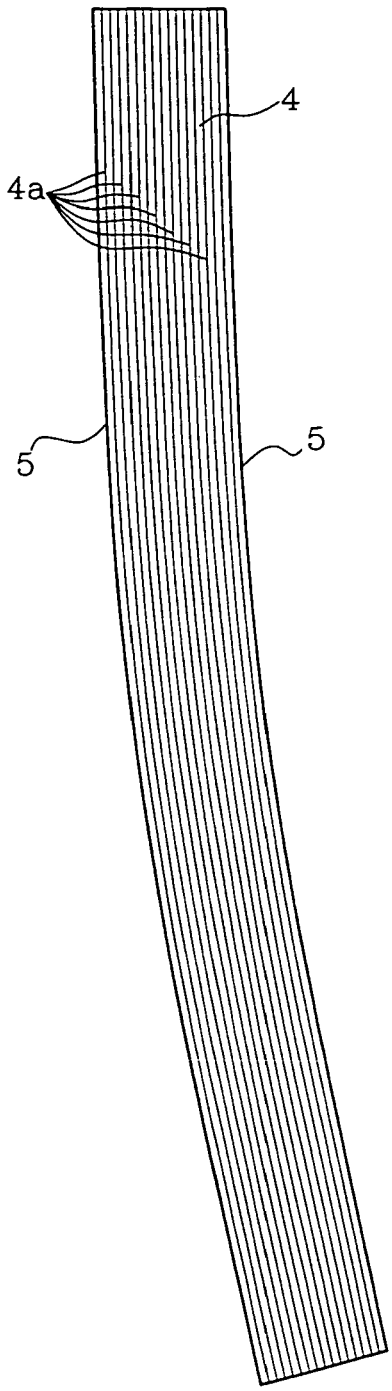
Figure 11:
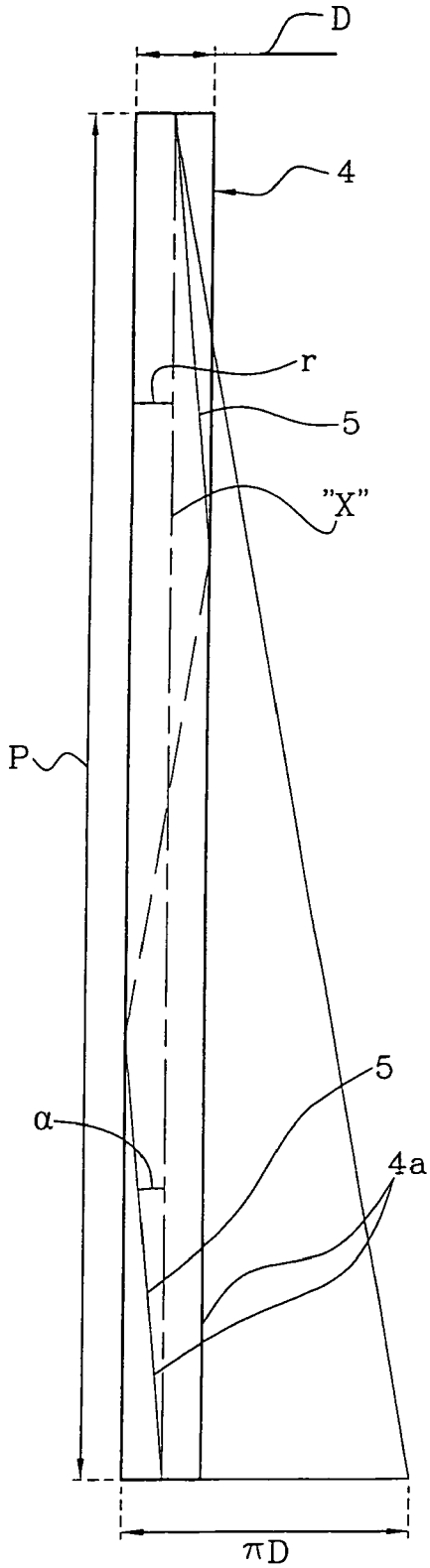

FIG. 9*a* is a view as in FIG. 1, with the fabric deformed due to inner tensions and with the indication of the axis of the "ribs" of deformed fabric and the correct cutting line;

FIG. 10 shows schematically a fabric cut in a traditional way, parallel to fabric ribs, and subject to structural deformation;

FIG. 10*a* shows schematically a fabric cut with a correct inclination according to the present invention and without structural deformation;

FIG. 11 shows a fabric tube with the indication of the helical cutting line corresponding to its structural deformation.

Referring to the accompanying figures, number 1 globally refers to a circular knitting machine according to the present invention.

Figure 1A:
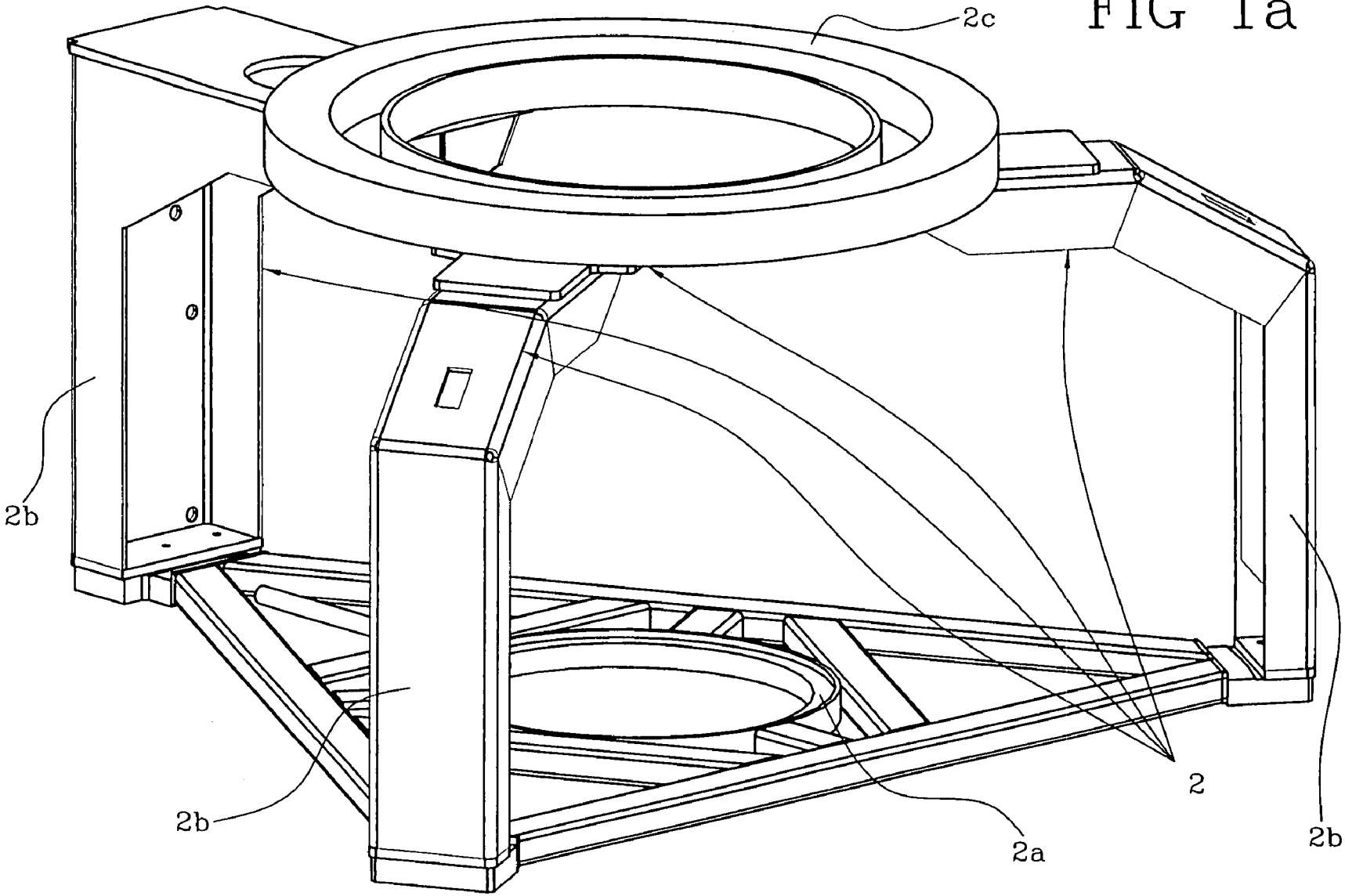

As can be seen in FIGS. 1 to 4, the circular knitting machine 1 (not shown completely) comprises a movable cylinder 2 and a stationary supporting frame 2 (FIG. 1*a*), including a lower stationary frame having a base 2*a*, three lateral propping legs 2*b* and an upper propping ring 2*c*. The movable cylinder 2 is mounted onto the upper ring 2*c*, on which cylinder a tubular fabric (represented with a hatched line in FIG. 2 and referred to with number 4) is progressively manufactured. The knitting machine 1 further comprises a take-down and collecting assembly 6 operatively engaged with the supporting frame 2 on the cylinder 3 for outspreading and collecting the tubular fabric produced by the cylinder 3. The movable cylinder 3 can be actuated so as to turn around a central rotation axis "X" and with a predefined angular speed suiting the tubular fabric currently manufactured. As shown in FIGS. 1 to 5, the takedown and collecting assembly 6 comprises a supporting frame 7 turning around the central rotation axis "X", the top of said frame being preferably provided with flattening means 8 for flattening the tubular fabrics from the cylinder 3.

The flattening means 8 include a spreading frame (not shown since already known) for progressively changing the cylindrical shape of the tubular fabric by flattening the latter basically in a diametrical direction, and a pair of parallel rollers 9 suitable spaced one from the other and delimiting the fabric under feeding.

Under the parallel rollers 9, cutting means 10 can be operatively arranged, which shall be described in further detail below and which progressively cut the fabric under feeding along a predefined cutting trajectory, and opening and outspreading means 11 for spreading the cut tissue in a single layer.

Still referring to FIGS. 1 to 5, the opening and outspreading means 11 comprise two divaricating rollers 12 for the fabric and the lateral edges thereof obtained by cutting, and a return roller 13 for the outspread fabric. Each divaricating roller 12 is preferably and advantageously provided with an independent motor 12*a*, which further helps to outspread the fabric under feeding. As can be seen in the figures, the divaricating rollers 12 are preferably inlined following lines diverging downwards, which results in a more uniform distribution of tractions exerted onto the fabric on the circumference of the cylinder.

A set of traction rollers 14 for feeding the fabric through the components of the take-down and collecting assembly 6 is engaged into a central portion of the supporting frame 7 of the take-down and collecting assembly 6, basically on the same lying plane as the return roller 13. A collecting assembly 15 for the fabric outspread in a single layer is arranged downstream from the set of traction rollers 14. As an alternative it can be provided for a device, known per se, for collecting the fabric in layers one upon the other. Advantageously, the machine 1 further comprises control means 16 (FIGS. 2 to 4) operatively associated with the take-down and collecting assembly 6 for actuating it in rotation at an angular speed varying from a minimum value below the angular speed of the movable cylinder 3, to a maximum value above the angular speed of the movable cylinder 3. Preferably, said control means 16 are operatively associated with at least an electronic control unit 17 (FIG. 1) arranged for instance inside a housing compartment within the supporting frame 2, and designed to adjust the angular speed of the cutting means 10 and/or of the takedown and collecting assembly 6 depending on the twisting rate of the tubular fabric produced on the cylinder 3. In other words, the electronic control unit 17 manages through the control means 16 the angular speed of the cutting means 10 and/or of the take-down and collecting assembly 6 so that the latter turn faster or slower than the cylinder 3 of the machine 1 so as to fulfill the aims of the invention, defining the cutting trajectory of the fabric. Preferably, the electronic control unit 17 is integrated into the conventional global electronic control system of the knitting machine, so as to be controlled by the conventional control means of the machine. Moreover, the electronic control unit 17 preferably acts upon the independent motors 12*a* of the divaricating rollers 12 for controlling an optimal fabric take-down proportional to the fabric cutting angle, which depends on the relative rotation between the take-down and collecting assembly 6 and the cylinder 3. The knitting machine can further include automatic detecting means (not shown in the figures), for instance optical means or of other type, which enable to detect automatically the inclination of the fabric deformation helix, and which are operatively connected to the electronic control unit 17.

Said means can be activated for instance when starting the production, manufacturing a portion of tubular fabric without tractions, letting it deform freely and detecting its deformation.

The value thus detected can be compared with the one manually set or with the one predicted depending on the type of yarn and on the remaining manufacturing parameters, as a further check on the correctness of the settings of the machine.

In particular and by way of example, the relative rotation of the take-down and collecting assembly 6 with respect to the cylinder 3 is subject to the following mathematical equations:

$$P=\pi\cdot 2r\cdot\tan(90-\alpha)$$

$$P=\pi D\cdot\tan(90-\alpha)$$

in which (see FIGS. 10*a* and 11) "P" is the torsion rate of the tubular fabric, i.e. the number of millimeters of tubular fabric required so that the cylinder 3 is offset of one turn with respect at least to the cutting means 10, and in case the latter are integral with the take-down and collecting assembly 6, also with respect to said assembly 6; "D" and "r" are respectively the diameter and radius of the tubular fabric; and "α" refers to the helix inclination degrees set (or automatically detected by the detecting means) in the electronic control unit 17 before activating the machine 1.

If the machine 1 is for instance a 30" circular knitting machine and helix inclination is of 5°, the pitch according to one of the above equations is of:

$$P=\pi\cdot 762\text{ mm}\cdot 11.43$$

$$P=27.348\text{ mm}=27.348\text{ m}$$

In this case the take-down and collecting assembly is delayed with respect to the cylinder 3 of one turn every 27.348 mm of tubular fabric produced.

Considering that the tubular fabric produced at every turn, which depends on various parameters of the manufacturing process and can be obtained from the rotation speed of the pulling roller (said value can be detected directly by the control unit 17 or be set manually), can be for instance of:

$$Prg=60\text{ mm/turn}$$

the rate in mm divided by the tubular fabric produced (Prg) gives the number of turns required for an offset of 360° C. (one turn) between the cylinder 3 and the take-down and collecting assembly 6.

$$27.348\text{ mm}:60\text{ mm/turn}=455.8\text{ turns}$$

Moreover, the 360° offset between the cylinder 3 and the take-down and collecting assembly 6 divided by the corresponding numbers of turns required for the take-down and collecting assembly 6 to be offset of 360° C., gives the angular offset pro turn between the take-down and collecting assembly 6 and the cylinder 3.

$$360°:455.8\text{ turns}=0.7890\text{ for every cylinder turn}$$

According to said parameters the take-down and collecting assembly 6 is thus delayed with respect to the cylinder 3 of 0.789° at every turn of the latter, the speed of the pulling roller being proportionally lower than the speed of the cylinder.

Conversely, if the machine 1 is a 30" circular knitting machine and helix inclination is of −5°, the pitch according to the above equation is of:

$$P=\pi\cdot 762\text{ mm}\cdot(-11.43)=-27.348\text{ mm}$$

In this case the take-down and collecting assembly 6 in rotation is in advance with respect to the cylinder 3 of one turn every 27.348 mm of tubular fabric produced.

Figure 2:
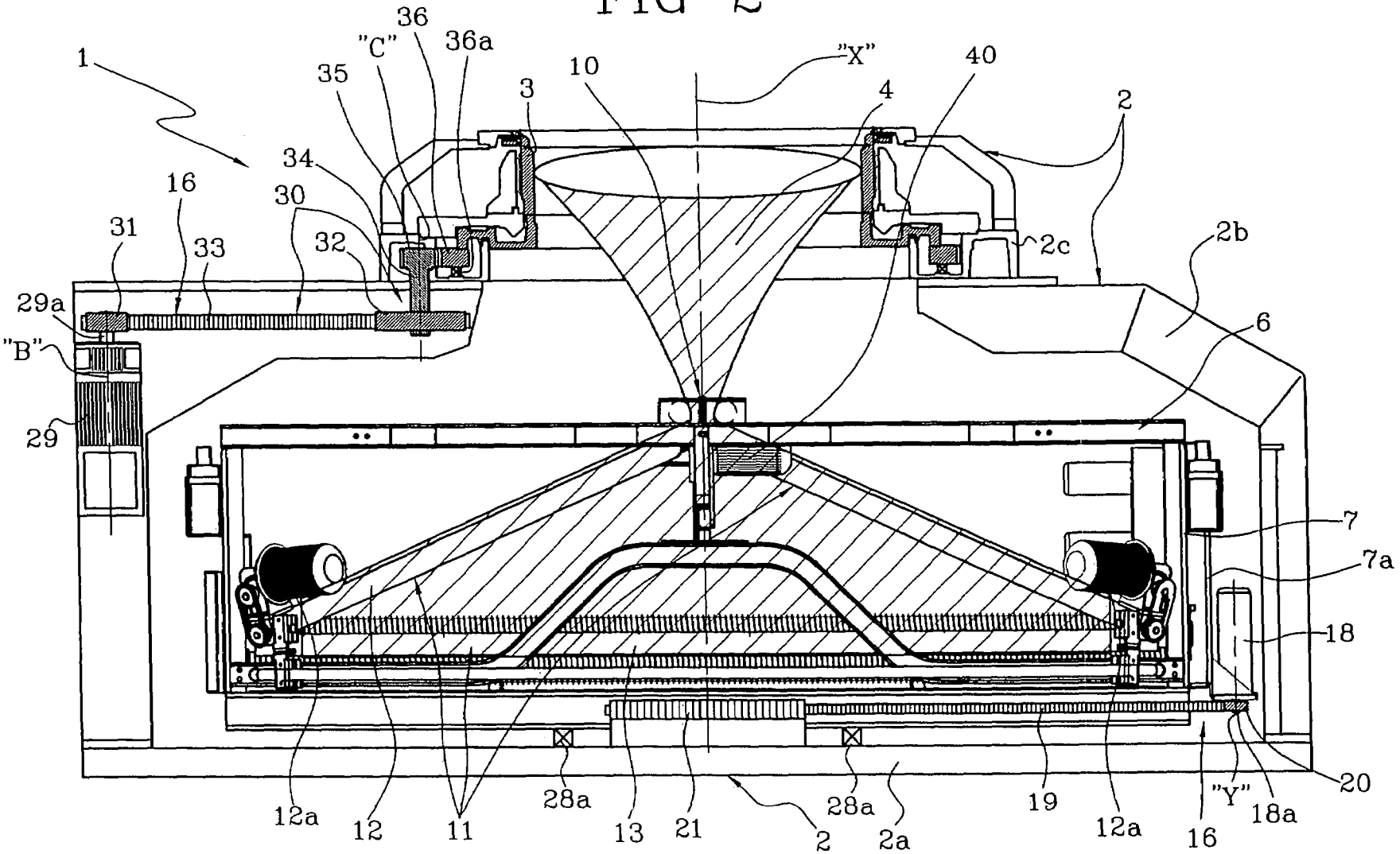
FIG. 2 is an elevation view of the device as in the previous figure, partially sectioned and shown according to a first embodiment of the present invention, the produced fabric being represented schematically.

According to a first embodiment of the present invention as shown in FIG. 2, the control means 16 comprise at least an electric motor 18, preferably a brushless motor or of any other convenient type, and driving means 19 operatively placed between the electric motor 18 and the take-down and collecting assembly 6 for actuating in rotation the latter at a predefined angular speed.

As can be seen in FIG. 2, the electric motor 18 is integrally engaged with a lateral edge 7*a* of the supporting frame 7 of the take-down and collecting assembly 6 so as to rotate together with the latter around the central rotation axis "X", and the driving means 19, connected to a drive shaft 18*a* developing below the electric motor 18, extend mainly below the take-down and collecting assembly 6. In further detail, the driving means 19 comprise a first drive pulley 20 fitted onto the drive shaft 18*a* of the electric motor 18. The first drive pulley 20 turns integrally with the drive shaft 18*a* around a first rotation axis "Y" basically parallel to the central rotation axis "X" of the cylinder 3 and of the take-down and collecting assembly 6. The driving means 19 further comprise a second drive pulley 21 lying basically on the same plane as the first drive pulley 20. The second drive pulley 21 operatively cooperates with the first drive pulley 20 and is stationary and integrally engaged with the stationary supporting frame 2 on the central rotation axis "X". A drive belt 22 is further operatively placed between the first and second drive pulley 20, 21. Said drive belt 22 partially envelopes the first and second drive pulley 20, 21 so as to draw into rotation the take-down and collecting assembly 6 as a result of a rotation of the first drive pulley 20 around the first rotation axis "Y".

Figure 3:
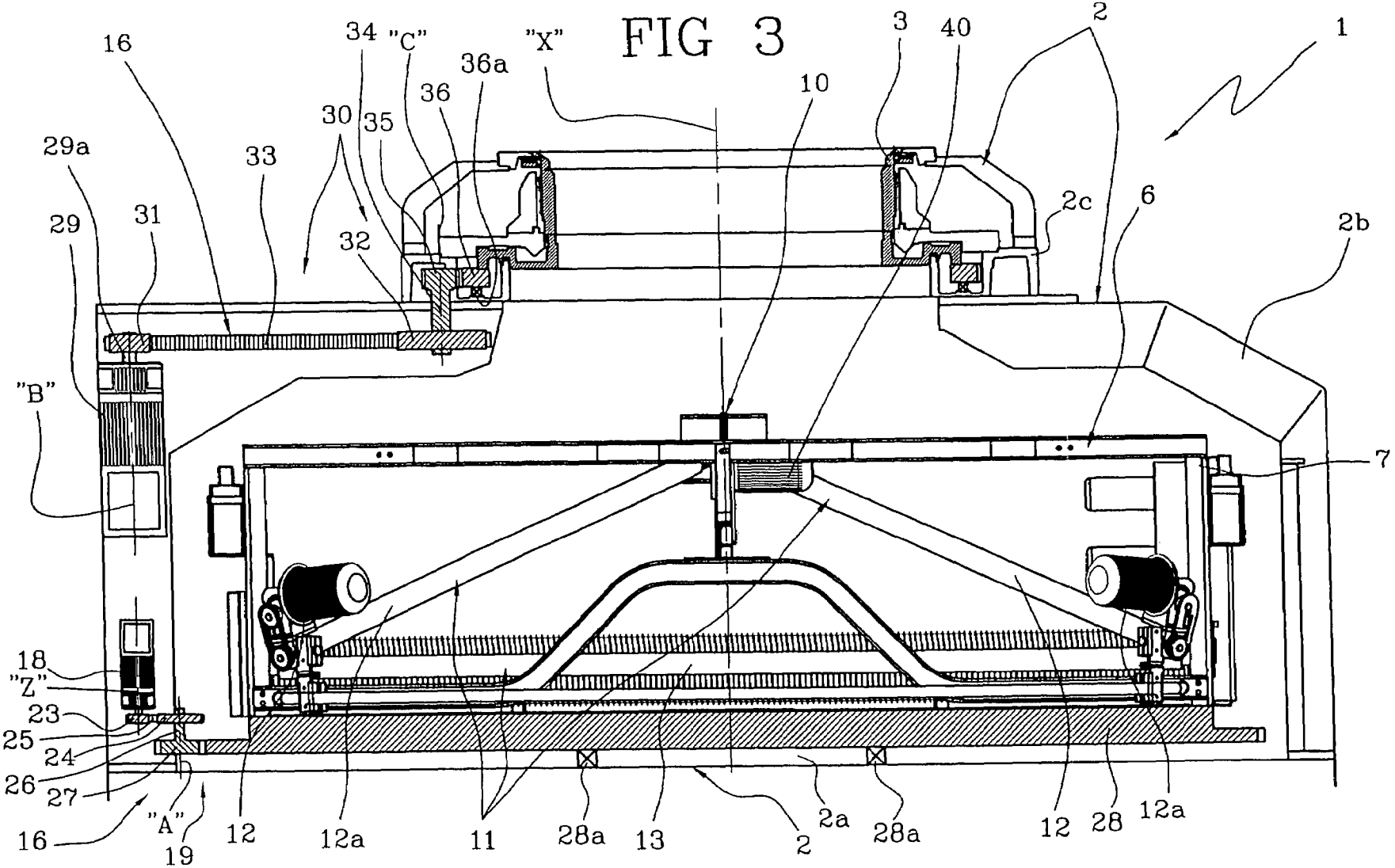
FIG. 3 is an elevation view of the device as in the previous figures, partially sectioned and shown according to a second embodiment of the present invention.

According to a second embodiment of the present invention as shown in FIG. 3, the motor 18 constituting together with the driving means 19 the control means 16 for actuating in rotation the take-down and collecting assembly 6, is integrally engaged with the stationary supporting structure 2. In other words, under these circumstances the take-down and collecting assembly 6 turns independently from the motor 18, which is stationary.

As can be seen in FIG. 3, the driving means 19, designed to actuate in rotation the take-down and collecting assembly 6, comprise a first drive pulley 23 fitted onto the drive shaft 18*a* of the motor 18 so as to turn around a first rotation axis "Z" basically parallel to the central rotation axis "X" of the cylinder 3 and of the take-down and collecting assembly 6. The driving means 19 further comprise a second drive pulley 24 lying basically on the same plane as the first pulley 23 and cooperating with the latter by means of a belt so as to turn as a result of a rotation of the first pulley 23. The second pulley 24 is further fitted onto a corresponding drive shaft 26 so as to rotate integrally with the latter around a second rotation axis "A" basically parallel to the first rotation axis "Z". Still referring to FIG. 3, the driving means 19 according to the second embodiment of the present invention further include a third toothed wheel 27 lying on a plane basically parallel to the lying plane of the first and second drive toothed wheels 23, 24. The third toothed wheel 27 is integrally engaged with an end of the drive shaft 26 so as to turn together with the latter and with the second toothed wheel 24 around the second rotation axis "A". The driving means 19 eventually comprise also a fourth toothed wheel 28 lying on the same plane as the third driving toothed wheel 27 and operatively engaged with the latter. The fourth toothed wheel 28 is integrally engaged with the take-down assembly 6 so as to turn together with the latter around the central rotation axis "X". In further detail, the fourth toothed wheel 28 wholly supports the take-down and collecting assembly 6 through suitable rolling means 28*a* operatively placed between the fourth toothed wheel 28 and the stationary supporting frame 2. Advantageously, as shown in FIG. 2 (first embodiment) and in FIG. 3 (second embodiment), the control means 16 further comprise a motor 29 of known type engaged with the stationary supporting frame 2 and second driving means 30 (of known type) operatively placed between the motor 29 and the cylinder 3 of the machine 1 so as to actuate in rotation the latter around the central rotation axis "X" and at a predefined angular speed.

In particular, the second driving means 30 comprise a first and a second drive pulley 31, 32 lying on the same plane and operatively connected one to the other by a drive belt 33. The first drive pulley 31 is fitted onto a drive shaft 29*a* of the motor 29 and can freely rotate around a first rotation axis "B" basically parallel to the central rotation axis "X" of the cylinder 3 and of the take-down and collecting assembly 6. Conversely, the second drive pulley 32 is fitted onto a corresponding drive shaft 34 so as to turn together with the latter around a second rotation axis "C" basically parallel to the first rotation axis "B".

The second driving means 30 further comprise a third and a fourth toothed wheel 35, 36 lying on the same plane basically parallel to the lying plane of the first and second drive pulley 31, 32 and cooperating so as to actuate in rotation the cylinder 3. The third toothed wheel 35 is integral with the drive shaft 34 so as to turn together with the latter and with the second drive pulley 32 around the second rotation axis "C". The fourth toothed wheel 36 is integrally engaged with the cylinder 3 of the machine 1 and engages the third toothed wheel 35 so as to actuate in rotation said cylinder at a desired angular speed. The fourth drive pulley 36 supports at least partially the cylinder 3 of the machine 1 through suitable rolling means 36*a* operatively placed between the fourth toothed wheel 36 and the stationary supporting frame 2.

Figure 4:
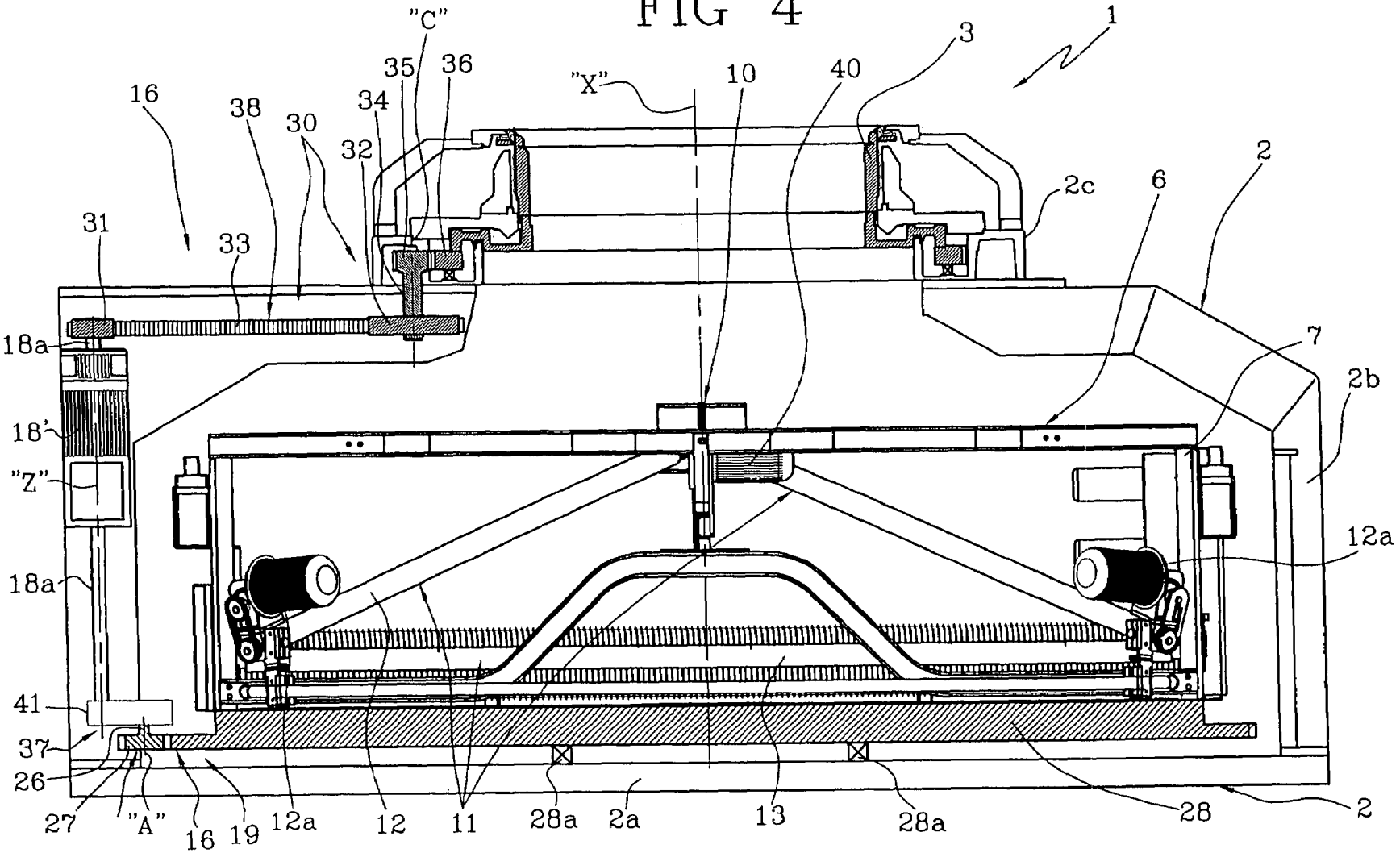
FIG. 4 is an elevation view of the device as in the previous figures, partially sectioned and shown according to a third embodiment of the present invention.

According to a third embodiment of the present invention as shown in FIG. 4, the control means 16 control and manage the movement of the cylinder 3 of the machine 1 and of the take-down and collecting assembly 6 by means of one motor 18' integrally engaged with the stationary supporting frame 2. In this case, the control means 16 are equipped with first and second driving means 37, 38, which are basically the same as the driving means 19 of the second embodiment, for the rotation of the take-down and collecting assembly 6, and as the second driving means 30, for the rotation of the cylinder 3. Under these circumstances, both the first and the second driving means 37, 38 exploit the movement of the drive shaft 18*a*' of the motor 18' with which they are engaged on opposite sides.

Obviously in this case, in order to vary the rotation speed of the collecting assembly with respect to the speed of the cylinder, the first driving means 37 (or alternatively the second driving means 38) comprise a speed variator 41, which can be actuated manually or better automatically by the electronic control unit 17. In order to reduce the reference numbers used to identify the components of the machine 1, the elements constituting the first driving means 37 have been basically provided with the same reference numbers used in the description of the driving means 19 of the second embodiment, and the elements constituting the second driving means 38 have been basically provided with the same numbers used in the description of the second driving means 30.

Obviously, the examples described above with reference to the various driving means used to actuate in rotation the cylinder 3 and the take-down and collecting assembly 6, do not limit in any way the present invention, which can also envisage any other type of known driving means for turning the take-down and collecting assembly 6 independently from the cylinder 3 of the machine 1.

Figure 6:
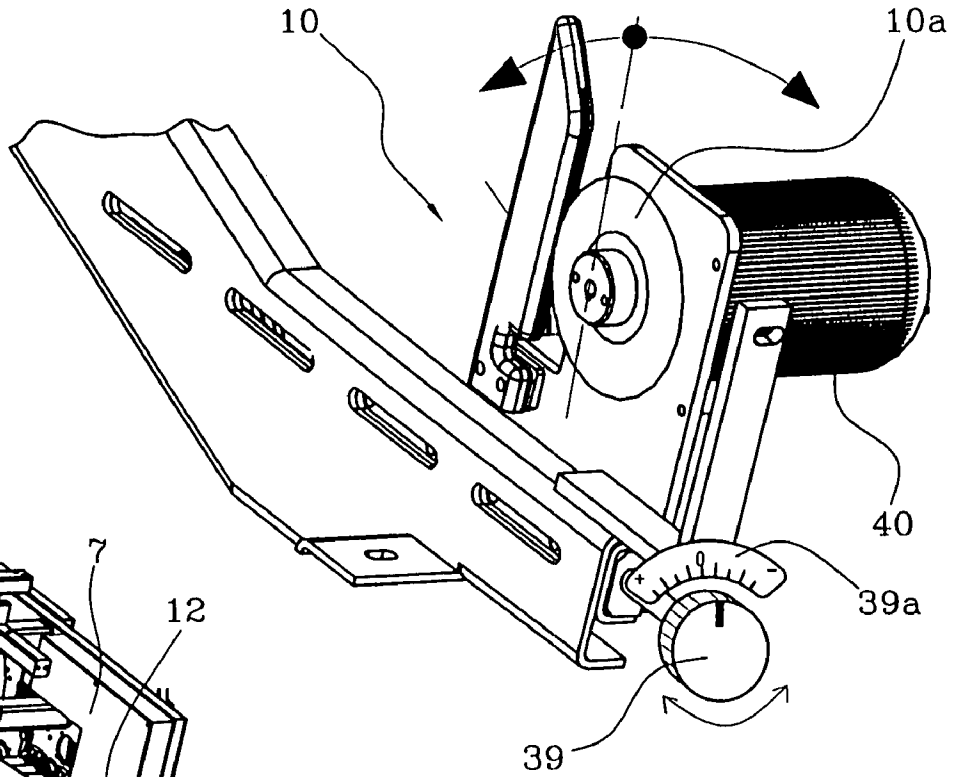
FIG. 6 is a magnified perspective view of cutting means of the take-down and collecting assembly of FIG. 5.
Figure 5:
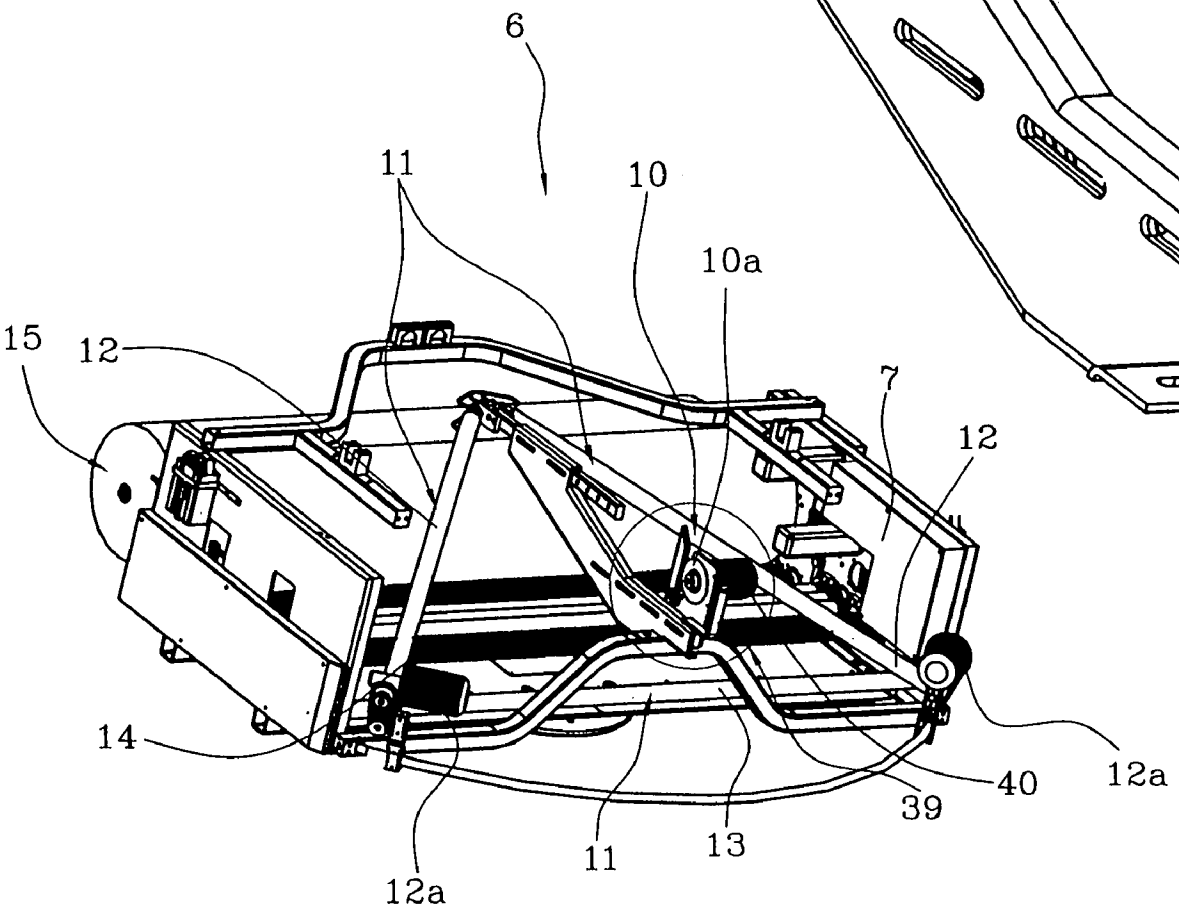
FIG. 5 is a perspective view of a take-down and collecting assembly of the machine as in the previous figures.

As can be seen in FIGS. 5 and 6, the aforesaid cutting means 10 comprise at least a cutting element 10*a* shifting between a first position, in which it is basically parallel with respect to said central rotation axis "X", and a second position, in which it is inclined with respect to said central rotation axis "X", so as to cut the tubular fabric from the cylinder 3 on a basically helical cutting trajectory whose pitch preferably corresponds to the twisting rate of said tubular fabric.

The position of the cutting element 10*a* is chosen proportionally to the difference of angular speed between the cylinder 3 and the cutting means 10 and/or the take-down and collecting assembly 6, so as to define the desired inclination of the cutting helix in order to follow the twisting helix of the tubular fabric produced by the machine. As can be seen in FIGS. 5 and 6, the cutting means 10 preferably further comprise at least an electric motor 40, advantageously controlled by the electronic control unit 17 for actuating the cutting element 10.

The cutting element 10*a* is further advantageously associated with actuating means 39 for shifting the cutting element 10*a* between the first and second position so as to place it in a suitable position for cutting the tubular fabric under feeding.

The actuating means 39 can be manual. In this case, the suitable position of the cutting element 10*a* for cutting the tubular fabric under feeding is achieved directly by an operator acting onto the actuating means 39 by shifting the latter with respect to a graduated scale 39*a*, before every activation of the machine 1 or when, due to manufacturing needs, a tubular fabric with different parameters with respect to the previous one has to be manufactured on said machine 1.

As an alternative, the actuating means 39 can be automatic and therefore be controlled directly by the electronic control unit 17 so as to define in an automatic and programmed way the cutting element 10 according to the desired inclination.

In a further execution variant of the first three embodiments, it can be provided for a rotary frame 7 integral with the cylinder 3 or anyhow turning in a synchronized way together with the cylinder 3, onto which the take-down and collecting assembly 6 can be mounted, which in this case is shifted on said rotary frame so as to obtain the desired difference of angular speed between the cutting means 10 and the cylinder 3.

Figure 7:
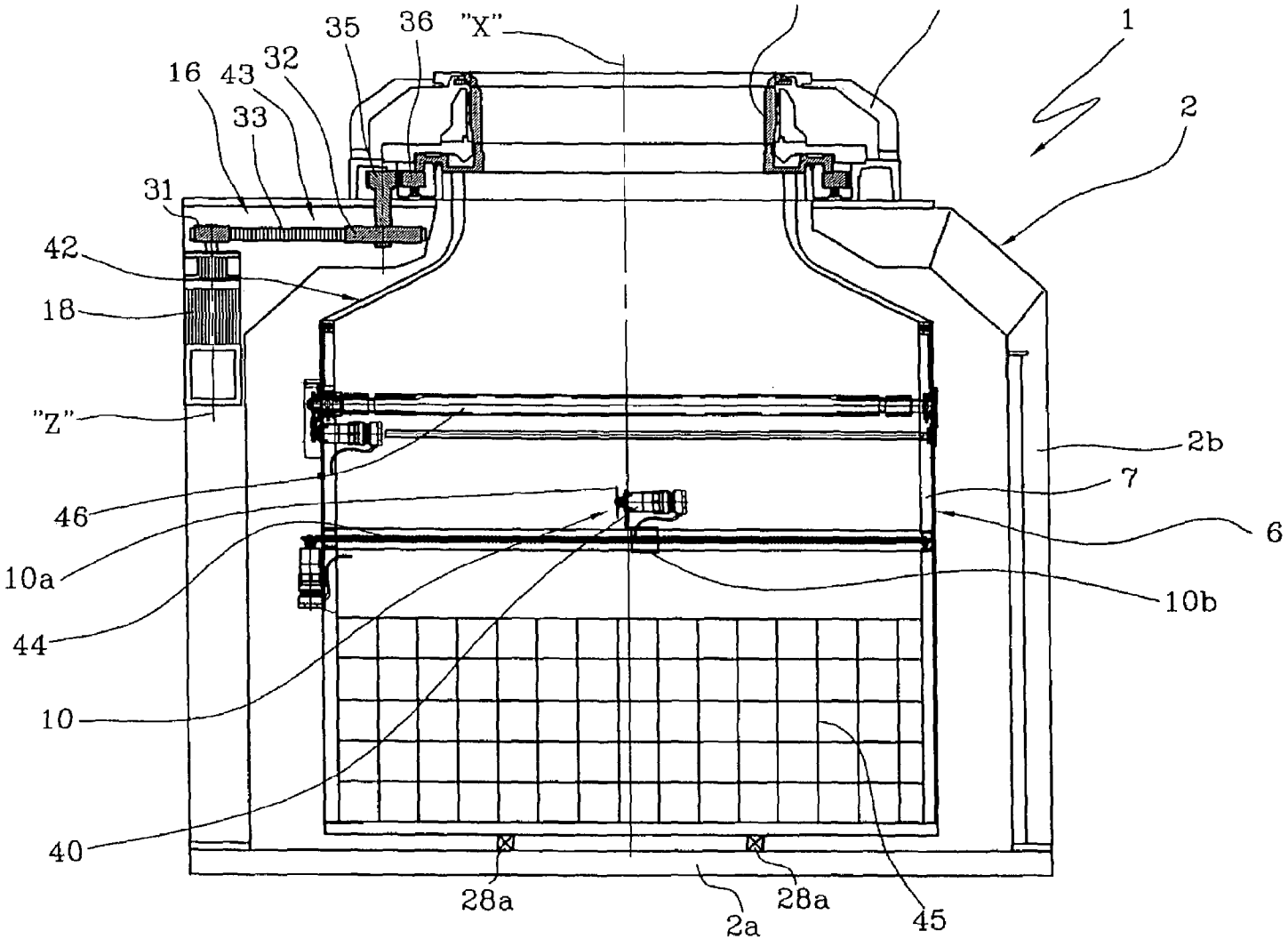
FIG. 7 is an elevation view of the device partially sectioned, according to a fourth embodiment of the present invention.
Figure 8:
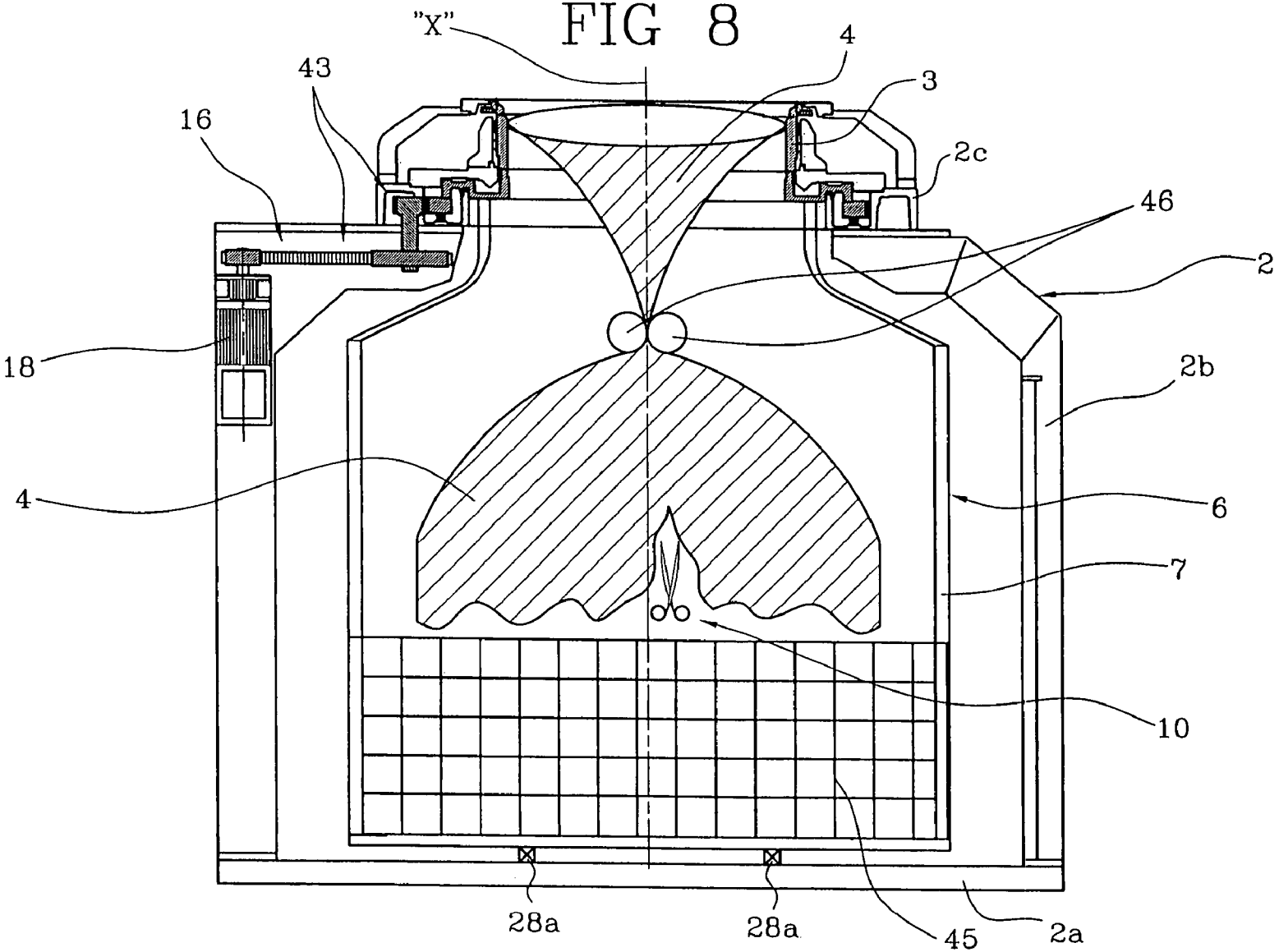
FIG. 8 is a schematic representation of fabric development in the machine of FIG. 7, in a view perpendicular to the view in FIG. 7.

According with the fourth embodiment of the present invention as shown in FIGS. 7 and 8, the take-down and collecting assembly 6 can be actuated in rotation around the central rotation axis "X" at the same angular speed as the cylinder 3. In further detail, the take-down and collecting assembly 6 is preferably engaged integrally with the cylinder 3 through at least a dragging frame 42 (FIG. 7) extending under the cylinder 3. When the cylinder 3 is actuated in rotation around the central rotation axis "X", it turns together with the dragging frame 42, which thus drags in rotation also the take-down and collecting assembly 6. Similarly to the embodiments described and disclosed above, the movement of the cylinder 3 is obtained thanks to a drive 43 having the same components as the second driving means 30 of the second embodiment, or as the second driving means 38 of the third embodiment. Also in this case, for reasons of clarity, the various components of the drive 43 have basically been provided with the same numbers as the other embodiments.

In this embodiment the cutting means 10 are the same as those already disclosed above, but shift on a basically ring-shaped guide 44 arranged on the take-down and collecting assembly 6 so as to turn around the central rotation axis "X" at a third angular speed differing from the angular speed of the cylinder 3 and of the collecting assembly 6. In particular, as can be seen in FIG. 7, the cutting means 10 are provided with a supporting flange 10*b* designed to prop both the cutting element 10*a* and its motor 40. The supporting flange 10*b* is operatively mounted onto the aforesaid guide 44 with coupling means (not shown since known per se) enabling it to glide according to the ring-shaped trajectory referred to above. The cutting means 10 are operatively associated with the control means 47 preferably interconnected to the electronic control unit 17, so that the latter can manage the movement of the cutting means 10 around the central rotation axis "X" automatically depending on the features of the tubular fabric under production, on the type of cut to be carried out and on the angular speeds of the various shifting elements. Obviously, here again the cutting element 10*a* of the cutting means 10 can be inclined proportionally to their rotation speed and therefore to the desired cutting trajectory, and can also be actuated directly by the electronic control unit 17.

In the fourth embodiment the fabric is taken down by a pair of traction rollers 46 and the cut fabric is collected by means of a lower basket 45 shown schematically in the figures.

FIG. 8 shows schematically the development of the fabric 4, which is first flattened (i.e. turned from its initial circular section to a shape whose section is a crushed ellipse) by means of the traction rollers 46 and a propping frame (not shown since of known type). Downstream from the traction rollers 46 the fabric is spread again by the same propping frame to take again a basically cylindrical shape, and the fabric freely gets down and is cut by the cutting means.

It should be pointed out that the cutting trajectory, inclined with respect to the central axis "X" and preferably basically helical, is determined depending on the twisting pitch of the tubular fabric due to yarn tensions and is obtained through a difference of angular speed between the cylinder and the take-down and collecting assembly (in the first embodiments) or between the cylinder and the cutting means (in the fourth embodiment).

The invention has important advantages.

First of all, the machine and the method according to the present invention enable to obtain fabrics in layers with a high level of quality and finish, which are not subject to significant structural deformations in the following manufacturing steps.

This can be achieved thanks to a fabric cut anticipating the subsequent natural twisting helix of the fabric due to inner tensions, thus preventing the following deformation of the "correctly" cut fabric.

Eventually, it should be pointed out that a machine and a method according to the present invention are not highly complex and are quite cheap.

The invention claimed is:

1. Method for collecting a fabric (4) produced by a cylinder (3) of a circular knitting machine (1), turning around a central axis ("X"), comprising the following steps:

taking down said fabric (4) produced by the cylinder;

cutting said fabric (4) progressively along a predefined cutting trajectory; and collecting said fabric (4);

said steps of taking down said fabric (4) produced by the cylinder, of cutting said fabric (4) and of collecting said fabric (4) being carried out by actuating in rotation a take-down and collecting assembly (6), equipped with cutting means (10) designed to cut said tubular fabric (4) from said cylinder (3), and arranged on said cylinder (3) for taking down and collecting said fabric (4), in which said cutting means (10) can be actuated in rotation at a speed different from said cylinder (3).

2. Method according to claim 1 characterized in that said cutting means (10) are integrally associated with said take-down and collecting assembly (6), which can be actuated independently from said cylinder (3) at a speed that can differ from the speed of the cylinder (3).

3. Method according to claim 1 characterized in that said cutting means (10) are turnably associated with said take-down and collecting assembly (6) and can be actuated in rotation independently from said cylinder (3) along a basically ring-shaped trajectory developing around the central rotation axis ("X") and at an angular speed differing from the angular speed of said cylinder (3) and take-down and collecting assembly (6), said take-down and collecting assembly (6) turning at the same angular speed as said cylinder (3).

4. Method according to claim 1, characterized in that it further comprises the following steps:

clenching said tubular fabric (4) from the cylinder (3) before said step of cutting the fabric (4);

divaricating said cut fabric (4) on lateral edges thereof defined by the cutting operation; and outspreading said divaricated fabric (4) before collecting said fabric (4).

5. Method according to claim 1, characterized in that said cutting trajectory is determined depending on the twisting pitch of said tubular fabric (4) and on the difference of angular speed between said cylinder (3), said take-down and collecting assembly (6) and said cutting means (10).

6. Circular knitting machine comprising:

a supporting frame (2);

a cylinder (3) associated with the supporting frame (2) and actuated in rotation around a central rotation axis ("X") at a first angular speed so as to produce at least a tubular fabric (4);

a take-down and collecting assembly (6) operatively associated with said supporting frame (2) and actuated in rotation around said central rotation axis ("X") at a second angular speed so as to engage and collect said tubular fabric (4) produced by said cylinder (3);

cutting means (10) operatively associated with said take-down and collecting assembly (6) so as to cut progressively said tubular fabric (4) along a predefined cutting trajectory, characterized in that said cutting means (10) are apt to cut said fabric (4) along a tilted trajectory as to the central station axis ("X").

7. Machine according to claim 6, characterized in that said cutting means (10) can be actuated in rotation around the central rotation axis ("X") at a third angular speed differing from the first angular speed of said cylinder (3).

8. Machine according to claim 6, characterized in that said cutting means (10) are integrally associated with said take-down and collecting assembly (6), which can be actuated in rotation at said second angular speed of said collecting assembly (6) independently from the motion of the cylinder (3).

9. Machine according to claim 8, characterized in that said second angular speed of said take-down and collecting assembly (6) can be varied between a minimum value below the first angular speed of said cylinder (3), and a maximum value above said first angular speed of said cylinder (3).

10. Machine according to claim 6, characterized in that said cutting means (10) can be actuated in rotation on a basically ring-shaped guide (44) arranged on said take-down and collecting assembly (6), and in that said third angular speed differs from the first angular speed of said cylinder (3) and from the second angular speed of said take-down and collecting assembly (6).

11. Machine according to claim 10, characterized in that said take-down and collecting assembly (6) turns integrally with said cylinder (3).

12. Machine according to claim 6, characterized in that it further comprises control means (16) operatively associated at least with said take-down and collecting assembly (6) and/or with said cutting means (10) so as to actuate them in rotation.

13. Machine according to claim 12, characterized in that said control means (16) define the motion of the cutting means and/or of the take-down and collecting assembly (6) according to a predefined relation between the first, the second and the third angular speed.

14. Machine according to claim 12, characterized in that it further comprises at least an electronic control unit (17) operatively associated with said control means (16) so as to adjust the angular speed of said cutting means (10) and/or of said take-down and collecting assembly (6) depending on the twisting pitch of said tubular fabric (4) produced on said cylinder (3) of said machine (1).

15. Machine according to claim 12, characterized in that it further comprises means for automatically detecting the twisting rate of said tubular fabric (4) produced on said cylinder (3), said means for automatic detection being operatively connected to said electronic control unit (17).

16. Machine according to claim 12, characterized in that said control means (16) comprise:

at least a motor (18); and driving means (19) operatively placed between said motor (18) and said take-down and collecting assembly (6) so as to actuate in rotation the latter at said second angular speed.

17. Machine according to claim 16, characterized in that said at least one motor (18) is integrally engaged with said take-down and collecting assembly (6) so as to turn together with the latter around said central rotation axis ("X").

18. Machine according to claim 12, characterized in that said control means (16) comprise:

a motor (18') integrally engaged with said supporting frame (2);

first driving means (37) operatively placed between said motor (18') and said take-down and collecting assembly (6) so as to actuate in rotation the latter around said central rotation axis ("X") at said second angular speed;

second driving means (38) operatively placed between said motor (18') and said cylinder (3) of said machine (1) so as to actuate in rotation the latter around said central rotation axis ("X") at said first predefined angular speed.

19. Machine according to claim 18, characterized in that said first driving means (37) or said second driving means (38) comprise means for varying the transmission ratio (41) for varying the rotation speed of said take-down and collecting assembly (6) and/or of said cylinder (3).

20. Machine according to claim 6, characterized in that said cutting means (10) comprise at least a cutting element (10*a*) shifting at least between a first position, in which it is inclined with respect to said central rotation axis ("X"), and a second position, in which it is inclined in the opposite direction and symmetrically with respect to said central rotation axis ("X"), said cutting element(10*a*) shifting between the first and the second graduated angular position depending on the difference of angular speed between the cutting means (10) and said cylinder (3).

21. Machine according to claim 20, characterized in that said cutting means (10) can be shifted automatically between said first and second position and are controlled and actuated by said electronic control unit (17).

* * * * *

UNITED STATES PATENT AND TRADEMARK OFFICE

CERTIFICATE OF CORRECTION

PATENT NO. : 7,162,895 B2
APPLICATION NO. : 11/104709
DATED : January 16, 2007
INVENTOR(S) : Tiberio Lonati It is certified that error appears in the above-identified patent and that said Letters Patent is hereby corrected as shown below:

On Title Page 1, please delete

"Related U.S. Application Data

(63) Continuation of application No. PCT/IT2004/000211, filed on Apr. 14, 2004."

and insert therefor

--(30) Foreign Application Priority Data

Apr. 14, 2004 [WO] WIPO.....PCT/IT2004/000211.--

Signed and Sealed this

Fifteenth Day of January, 2008

JON W. DUDAS
*Director of the United States Patent and Trademark Office*